US008985577B2

(12) United States Patent
Maruta

(10) Patent No.: US 8,985,577 B2
(45) Date of Patent: Mar. 24, 2015

(54) SHEET CONVEYOR DEVICE AND IMAGE FORMING APPARATUS

(71) Applicant: KYOCERA Document Solutions Inc., Osaka (JP)

(72) Inventor: Masaaki Maruta, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/251,684

(22) Filed: Apr. 14, 2014

(65) Prior Publication Data

US 2014/0319763 A1 Oct. 30, 2014

(30) Foreign Application Priority Data

Apr. 24, 2013 (JP) ..... 2013-091148

(51) Int. Cl.

| | |
|---|---|
| ***B65H 9/00*** | (2006.01) |
| ***B65H 7/14*** | (2006.01) |
| ***B65H 7/20*** | (2006.01) |
| ***B65H 5/06*** | (2006.01) |

(52) U.S. Cl.

CPC ..... *B65H 7/20* (2013.01); *B65H 5/062* (2013.01); *B65H 9/00* (2013.01); *B65H 7/14* (2013.01)

USPC ..... 271/228; 271/227; 271/242

(58) Field of Classification Search

USPC ..... 271/226–228, 242

See application file for complete search history.

(56) References Cited

FOREIGN PATENT DOCUMENTS

JP H06-271151 A 9/1994

*Primary Examiner* — Patrick Cicchino

(74) *Attorney, Agent, or Firm* — Studebaker & Brackett PC

(57) ABSTRACT

A sheet conveyor device includes a registration roller, an intermediate roller, a first sheet detection section, a first drive controller, a second drive controller, and a third drive controller. The registration roller conveys a sheet toward an image forming section for image formation. The intermediate roller conveys the sheet toward the registration roller. The first sheet detection section is used for optically detecting the sheet between the registration roller and the intermediate roller. The first drive controller drives the intermediate roller, while suspending driving of the registration roller. The second drive controller drives the registration roller when a predetermined conveyance wait period elapses from detection of a sheet by the first sheet detection section. The third drive controller drives the registration roller when a predetermined forced conveyance period elapses from a start of conveyance of the sheet loaded on a sheet loading section.

8 Claims, 6 Drawing Sheets

SHEET CONVEYOR DEVICE AND IMAGE FORMING APPARATUS

INCORPORATION BY REFERENCE

The present application claims priority under 35 U.S.C. §119 to Japanese Patent Application No. 2013-091148, filed Apr. 24, 2013. The contents of this application are incorporated herein by reference in their entirety.

BACKGROUND

The present disclosure relates to a sheet conveyor device to convey a sheet to an image forming section for image formation and an image forming apparatus including it.

For image forming apparatuses, such as printers, a sheet conveyor device is provided which conveys a sheet to an image forming section for image formation. Specifically, the sheet conveyor device includes a registration roller, an intermediate roller, a sheet detection section, etc. The registration roller conveys a sheet toward a transfer section. The intermediate roller conveys a sheet toward the registration roller. The sheet detection section detects a sheet between the intermediate roller and the registration roller.

Further, inclination (skew) of a sheet may be corrected by drive control on the registration roller and the intermediate roller in some sheet conveyor device. For example, when a predetermined period elapses from sheet detection by the sheet detection section after the intermediate roller conveys a sheet, while rotation of the registration roller is suspended, the registration roller starts being driven. This causes the sheet to be pushed against the registration roller under suspension, thereby forming a deflection in the sheet. Accordingly, inclination of the sheet is corrected. An optical sensor of reflection type that optically detects the presence/absence of a sheet may be used as the sheet detection section.

SUMMARY

A sheet conveyor device according to the first aspect of the present disclosure includes a registration roller, an intermediate roller, a first sheet detection section, a first drive controller, a second drive controller, and a third drive controller. The registration roller conveys a sheet toward an image forming section for image formation. The intermediate roller conveys the sheet toward the registration roller. The first sheet detection section is used for optically detecting the sheet between the registration roller and the intermediate roller. The first drive controller drives the intermediate roller, while suspending driving of the registration roller. The second drive controller drives the registration roller when a predetermined conveyance wait period elapses from detection of the sheet by the first sheet detection section. The third drive controller drives the registration roller when a predetermined forced conveyance period elapses from a start of conveyance of the sheet loaded on a sheet loading section.

A sheet conveyor device according to the second aspect of the present disclosure further includes a second sheet detection section and an abnormality detection section in the above sheet conveyor device. The second sheet detection section is used for detecting the sheet between the registration roller and the image forming section. The abnormality detection section detects abnormality in sheet conveyance where the second sheet detection section detects no sheet until a predetermined abnormality conveyance period elapses from the start of conveyance of the sheet loaded on the sheet loading section.

An image forming apparatus according to the third aspect of the present disclosure includes the sheet conveyor device according to the first aspect and the image forming section.

An image forming apparatus according to the fourth aspect of the present disclosure includes the sheet conveyor device according to the second aspect and the image forming section.

DETAILED DESCRIPTION

Figure 1:
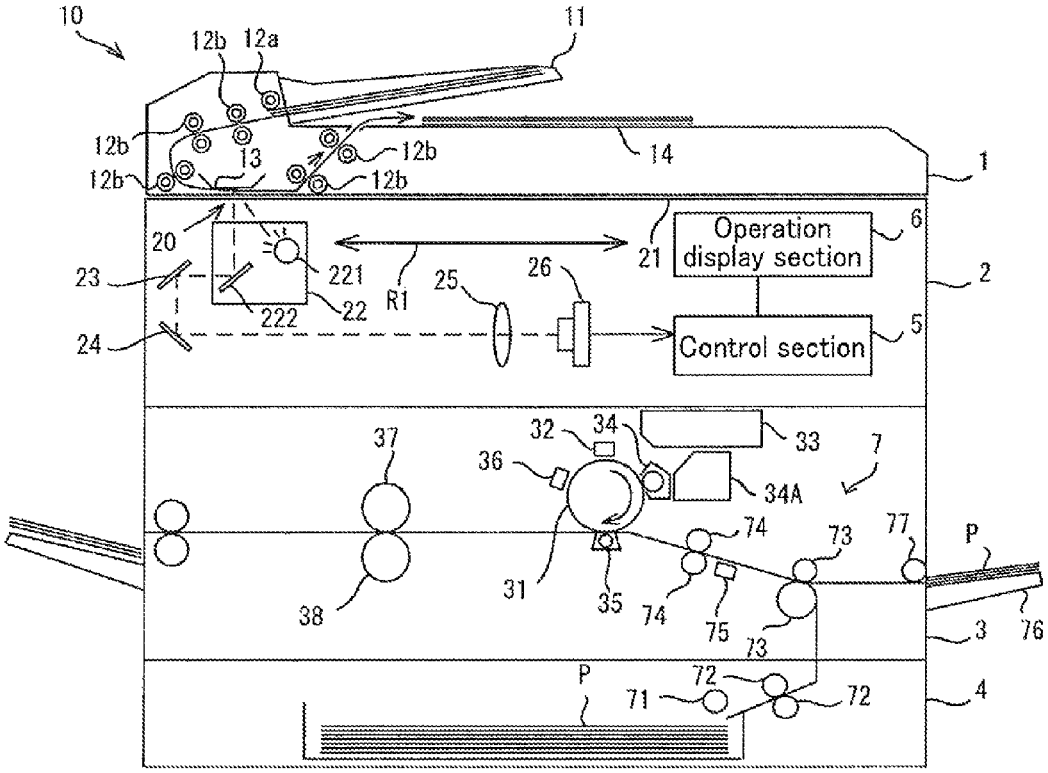
FIG. 1 is a diagram showing a configuration of a multifunction peripheral according to one embodiment of the present disclosure.

With reference to the accompanying drawings, embodiments of the present disclosure will be described below to aid in understanding the present disclosure. It should be noted that the same numerals may be used for the same or corresponding elements in the drawings to omit duplicate description. The following embodiments are mere specific examples of the present disclosure and are therefore not intended to limit the technical scope of the present disclosure.

[Schematic Configuration of Multifunction Peripheral 10]

With reference to FIG. 1, the configuration of a multifunction peripheral 10 according to one embodiment of the present disclosure will be described first.

As shown in FIG. 1, the multifunction peripheral 10 is an image forming apparatus including an auto document feeder (ADF) 1, an image reading section 2, an electrographic image forming section 3, a sheet feed cassette 4, a control section 5, an operation display section 6, a sheet conveyance section 7, etc. It is noted that the present disclosure is applicable also to any other image forming apparatuses, such as printers, facsimile machines, and copiers. Further note that the sheet conveyance section 7 and the control section 5 in the present embodiment correspond to a sheet conveyor device according to the present disclosure.

The ADF 1 includes a document setting section 11, a conveyance roller 12*a*, a plurality of conveyance roller pairs 12*b*, an original cover 13, a document discharging section 14, etc. In the ADF 1, when a motor (not shown) drives the conveyance roller 12*a* and the conveyance roller pairs 12*b*, an original document loaded on the document setting section 11 is conveyed to the document discharging section 14. At that time, the original document passes through an image data reading point 20 in the image reading section 2. Thus, the image reading section 2 can read image date from the original document conveyed by the ADF 1.

The image reading section 2 includes a document table 21, a light source unit 22, mirrors 23 and 24, an optical lens 25, a charge coupled device (CCD) 26, etc. The document table 21 is a document loading section provided on top of the device main body. The light source unit 22 is capable of being moved in a sub scanning direction R1 by a motor (not shown). Further, the light source unit 22 includes an LED light source 221 and a minor 222. The LED light source 221 includes multiple white LEDs arranged in the main scanning direction (depth direction of the sheet of FIG. 1). The LED light source 221 irradiates light to the surface of an original document on the document table 21. The mirror 222 reflects the light reflected by the surface of the original document toward the minor 23. Then, the mirror 24 guides the light reflected by the mirror 23 to the optical lens 25. The optical lens 25 collects the incident light and allows it to enter the CCD 26. The CCD 26 includes a photoelectric conversion element, etc. The CCD 26 inputs electric signals to the control section 5 according to the amount of received light entering from the optical lens 25 as image data of the original document.

The image forming section 3 forms an image on a sheet P on the basis of image data read by the image reading section 2 or image data input from an external information processing device, such as a personal computer. Specifically, the image forming section 3 includes a photosensitive drum 31, a charger 32, a laser scanning unit (LSU) 33, a developing device 34, a transfer roller 35, a static eliminator 36, a fixing roller 37, a pressure roller 38, etc. The image forming section 3 forms an image on a sheet P supplied from the sheet feed cassette 4 or the manual feed tray 76 in the following manner. It is noted that the sheet feed cassette 4 and the manual feed tray 76 are examples of a sheet loading section on which a sheet P is to be loaded.

First, the charger 32 uniformly charges the photosensitive drum 31 at a predetermined potential. Next, the LSU 33 irradiates light based on image data to the surface of the photosensitive drum 31. This forms an electrostatic latent image corresponding to the image data on the surface of the photosensitive drum 31. Then, the developing device 34 develops (visualizes) the electrostatic latent image on the photosensitive drum 31 as a toner image. The developing device 34 is replenished with toner (developer) from a toner container 34A detachable from the image forming section 3. Subsequently, the transfer roller 35 transfers the toner image formed on the photosensitive drum 31 to a sheet P. Then, the sheet P passes between the fixing roller 37 and the pressure roller 38. At that time, the fixing roller 37 and the pressure roller 38 applies heat and pressure, respectively, to the toner image transferred to the sheet P for melting and fixing. The static eliminator 36 removes the charge on the photosensitive drum 31. It is noted that the image forming section 3 is not limited to the electrographic image forming section and may be an image forming section of inkjet type, for example.

The control section 5 is a computer including control devices, such as a CPU, a ROM, a RAM, an EEPROM, etc. The CPU is a processor that executes various types of arithmetic processing. The ROM is a volatile storage section. The ROM stores in advance information, such as control programs for allowing the CPU to execute the various types of arithmetic processing. The RAM is a volatile storage section. The EEPROM is a nonvolatile storage section. The RAM and the EEPROM are used as temporary storage memories (work areas) for the various types of arithmetic processing that the CPU executes.

The control section 5 totally controls the multifunction peripheral 10 by executing various types of control programs stored in advance in the ROM with the use of the CPU. The control section 5 may be an electronic circuit, such as an integrated circuit of ASIC, DSP, or the like. Alternatively, the control section 5 may have a configuration including a main controller to totally control the multifunction peripheral 10 and a separate engine controller to control the image forming section 3 and the like.

The ROM or the EEPROM stores in advance a control program to allow the CPU to execute sheet conveyance processing. The sheet conveyance processing will be described later with reference to FIGS. 3A and 3B. The control program may be read from a computer readable recording medium, such as a CD, DVD, flash memory, etc. and be installed in the EEPROM or a storage, such a hard disk (not shown). It may be considered that the present disclosure is directed to a method for executing various processes for the sheet conveyance processing in the multifunction peripheral 10, a program to allow the control section 5 to execute the various processes for the sheet conveyance processing, or a computer readable recording medium that records the program.

The operation display section 6 includes a display section, such as a liquid crystal display, and an operation section, such as a hard key or a touch panel. The display section displays various information according to control instructions from the control section 5. The operation section inputs various information to the control section 5 according to user's operation.

Figure 2:
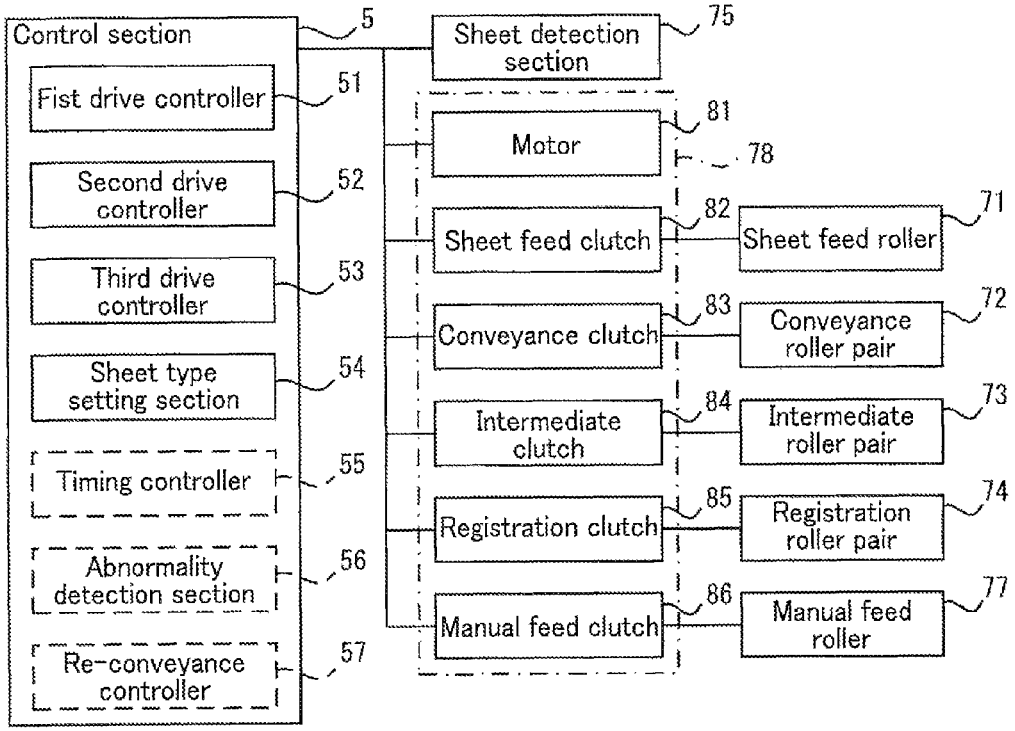
FIG. 2 is a block diagram showing a system configuration of the multifunction peripheral according to one embodiment of the present disclosure.

The sheet conveyance section 7 includes a sheet feed roller 71, a conveyance roller pair 72, an intermediate roller pair 73, a registration roller pair 74, a sheet detection section 75, a manual feed tray 76, a manual feed roller 77, and a drive section 78 (see FIG. 2).

The sheet feed roller 71 takes out sheets P from the sheet feed cassette 4 on sheet-by-sheet basis. The conveyance roller pair 72 rotates while sandwiching a sheet P taken out by the sheet feed roller 71. This conveys the sheet P toward the intermediate roller pair 73.

On the manual feed tray 76, a sheet P may be loaded as a target for image formation in the image forming section 3. The manual feed tray 76 is used particularly for loading a sheet of specific type, such as a viewgraph. A sheet P loaded on the manual feed tray 76 is conveyed generally straight in the interior of the multifunction peripheral 10. The manual feed roller 77 conveys the sheet P loaded on the manual feed tray 76 toward the intermediate roller pair 73.

The intermediate roller pair 73 rotates while sandwiching a sheet P conveyed from the conveyance roller pair 72 or the manual feed roller 77. Thus, the sheet P is conveyed toward the registration roller pair 74.

The registration roller pair 74 conveys a sheet P conveyed from the intermediate roller pair 73 toward the photosensitive drum 31. Further, the registration roller pair 74 is used for synchronization control between timing of image formation by the image forming section 3 and timing of sheet conveyance, for correction of sheet inclination (skew), etc.

The sheet detection section 75 is arranged between the registration roller pair 74 and the intermediate roller pair 73. The sheet detection section 75 optically detects a sheet P conveyed from the intermediate roller pair 73 toward the registration roller pair 74. The sheet detection section 75 corresponds to a first sheet detection section.

Specifically, the sheet detection section 75 is a reflective type optical sensor. The reflective type optical sensor includes a light emitting section and a light receiving section. The light emitting section irradiates light toward a sheet conveyance path between the registration roller pair 74 and the intermediate roller pair 73. The light receiving section receives light reflected by a sheet P. Upon detection of light, of which light amount is equal to or larger than a predetermined amount, by the light receiving section, the sheet P is detected. It is noted that the sheet detection section 75 may be an optical sensor of light shielding type that includes a light emitting section and a light receiving section, which are arranged to face each other. In this case, when a sheet P shields the light irradiated from the light emitting section to the light receiving section, the sheet P is detected.

Signals from the sheet detection section 75 are input to the control section 5. Thus, the control section 5 can control timing of driving the registration roller pair 74, timing of image formation by the image forming section 3, etc. on the basis of timing of sheet detection by the sheet detection section 75.

The drive section 78 will be described next with reference to FIG. 2. The drive section 78 includes a motor 81, a sheet feed clutch 82, a conveyance clutch 83, an intermediate clutch 84, a registration clutch 85, and a manual feed clutch 86. The control section 5 controls the motor 81, the sheet feed clutch 82, the conveyance clutch 83, the intermediate clutch 84, the registration clutch 85, and the manual feed clutch 86.

The motor 81 drives the sheet feed roller 71, the conveyance roller pair 72, the intermediate roller pair 73, the registration roller pair 74, and the manual feed roller 77 through a gear (not shown) and the like. The motor 81 may be a DC motor, for example.

The sheet feed clutch 82 is an electromagnetic clutch to switch transmission of the drive force from the motor 81 to the sheet feed roller 71 between on and off states. Similarly, the conveyance clutch 83 and the intermediate clutch 84 are electromagnetic clutches to switch transmission of the drive force from the motor 81 to the conveyance roller pair 72 and the intermediate roller pair 73 between on and off states, respectively. The registration clutch 85 and the manual feed clutch 86 are electromagnetic clutches to switch transmission of the drive force from the motor 81 to the registration roller pair 74 and the manual feed roller 77 between on and off states, respectively. It is noted that although the present embodiment describes a configuration in which the electromagnetic clutches switch transmission of the drive force from the motor 81 to the respective rollers between on and off states as one example, dedicated stepping motors may drive the respective rollers independently.

Further, as shown in FIG. 2, the control section 5 includes a first drive controller 51, a second drive controller 52, a third drive controller 53, and a sheet type setting section 54. Specifically, the control section 5 executes a control program stored in the ROM with the use of the CPU to function as the first drive controller 51, the second drive controller 52, the third drive controller 53, and the sheet type setting section 54. The first drive controller 51 drives the intermediate roller pair 73, while suspending the rotation of the registration roller pair 74. The second drive controller 52 drives the registration roller pair 74 when a predetermined conveyance wait period elapses from sheet detection by the sheet detection section 75. The third drive controller 53 drives the registration roller pair 74 when a predetermined forced conveyance period elapses from a start of conveyance of a sheet P loaded on the sheet feed cassette 4 or the manual feed tray 76. The sheet type setting section 54 receives an operation of setting a sheet type of a to-be-conveyed sheet P. The operation of setting a sheet type is performed through user's input to the operation display section 6.

[Sheet Conveyance Processing]

Figure 3A:
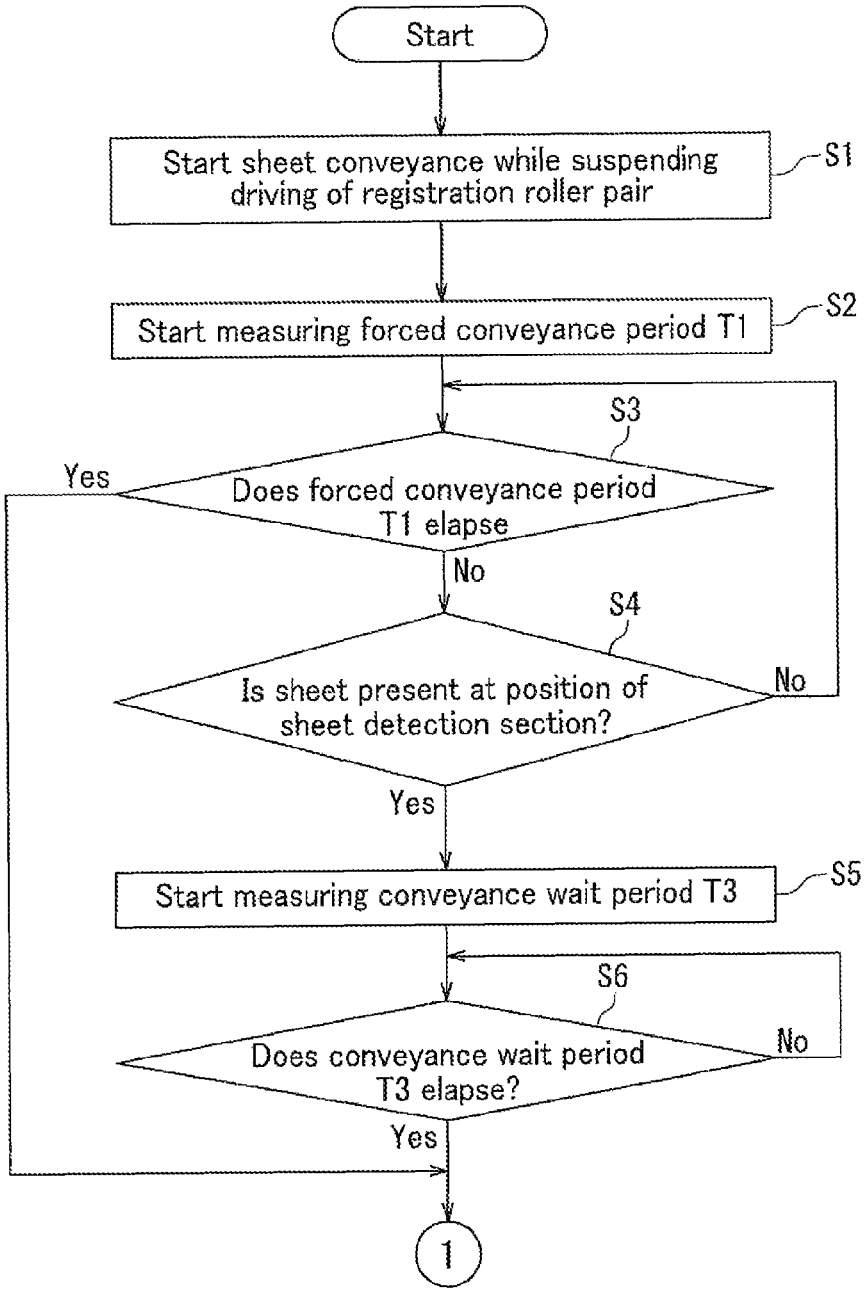
FIG. 3A is a flowchart depicting a process of sheet conveyance processing performed in the multifunction peripheral according to one embodiment of the present disclosure.
Figure 3B:
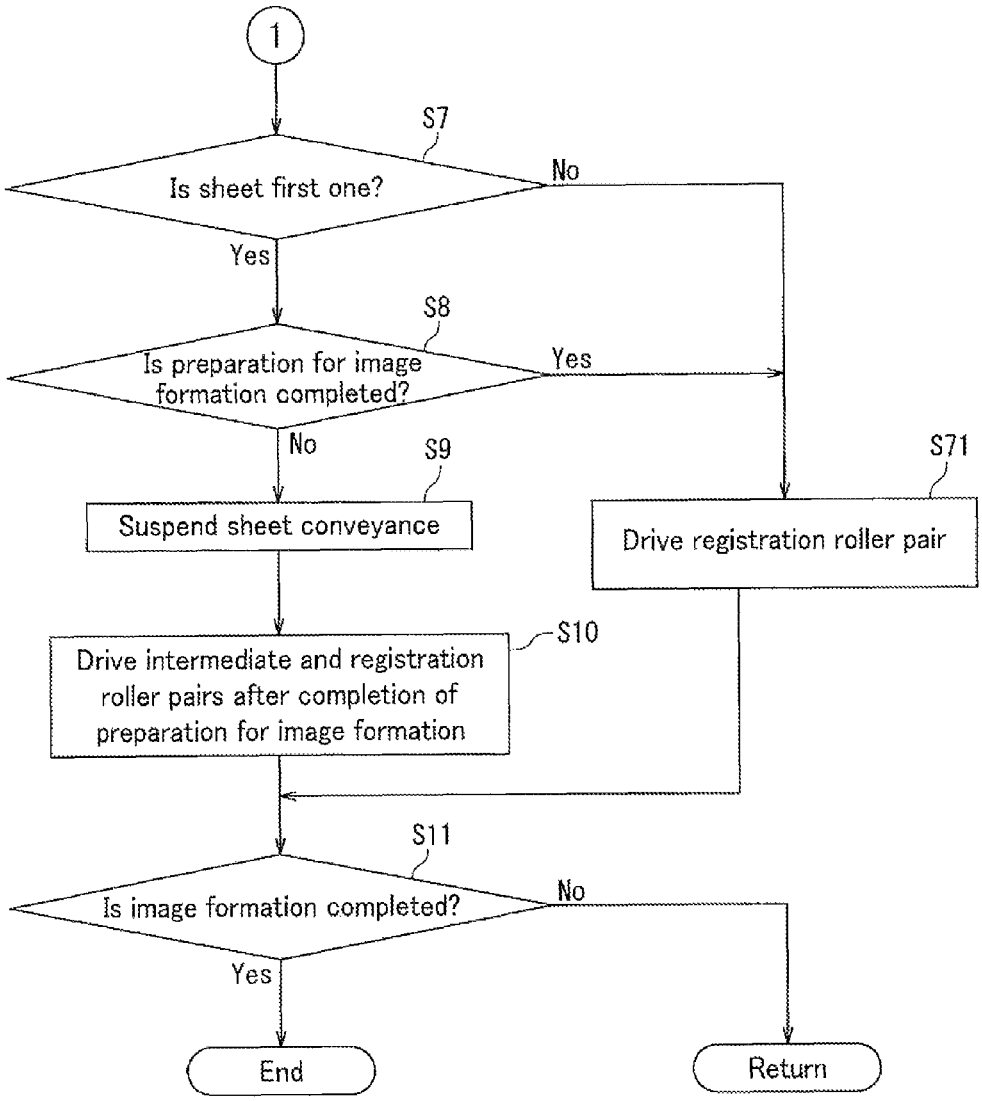
FIG. 3B is a flowchart depicting a process of the sheet conveyance processing performed in the multifunction peripheral according to one embodiment of the present disclosure.

One example of a process of the sheet conveyance processing that the control section 5 executes will be described below with reference to the flowcharts of FIGS. 3A and 3B. It is noted that steps S1, S2, . . . each denote the number of a process operation (step) that the control section 5 executes. The sheet conveyance processing is executed by the control section 5 when image formation processing is performed in the multifunction peripheral 10, such as printing, coping, or faxing. One example will be described herein in which sheet supply from the manual feed tray 76 is set in advance in the control section 5 in accordance with user's manipulation performed on the operation display section 6, and then, the image formation processing is performed.

<Step S1>

First, at a step S1, the control section 5 causes conveyance of a sheet P from the manual feed tray 76 to the registration roller pair 74, while suspending rotation of the registration roller pair 74. The first drive controller 51 executes the operation of the step S1. Specifically, the control section 5 turns off the registration clutch 85, turns on the intermediate clutch 84 and the manual feed clutch 86, and drives the motor 81. Thus, the manual feed roller 77 and the intermediate roller pair 73 convey the sheet P loaded on the manual feed tray 76 toward the registration roller pair 74.

It is noted that in the case where supply of a sheet P from the sheet feed cassette 4 is set in the control section 5 in advance, the control section 5 turns on the sheet feed clutch 82, the conveyance clutch 83, and the intermediate clutch 84 and drives the motor 81, while turning off the registration clutch 85. Thus, the sheet feed roller 71, the conveyance roller pair 72, and the intermediate roller pair 73 convey the sheet P accommodated in the sheet feed cassette 4 toward the registration roller pair 74.

<Step S2>

At a step S2, the control section 5 starts measuring a predetermined forced conveyance period T1 from the start of conveyance of the sheet P loaded on the manual feed tray 76. Then, the routine proceeds to a step S3. The forced conveyance period T1 is a predetermined logical value as a time period from a start of sheet conveyance in the step S1 to the time when a deflection with a first predetermined volume is formed in the sheet P in a manner that the sheet P abuts on and is pushed further against the registration roller pair 74. Specifically, the forced conveyance period T1 is set in advance according to the sheet conveyance speed, the length of the conveyance path, and the like in the sheet conveyance section 7. Further, the forced conveyance period T1 is set in advance for each of the manual feed tray 76 and the sheet feed cassette 4. The control section 5 changes the forced conveyance period T1 according to which the sheet P is conveyed from, the manual feed tray 76 or the sheet feed cassette 4. It is noted that when the control section 5 changes the sheet conveyance speed in the sheet conveyance section 7 according to the sheet type of a sheet P, the forced conveyance period T1 is also changed according to the sheet type of the sheet P.

The forced conveyance period T1 is a time period (T1=T2+T3+T4) longer by a predetermined delay period T4 than a sum of a conveyance period T2 and a conveyance wait period T3. The conveyance period T2 is a logical value predetermined as a period from a start of sheet conveyance to detection of the sheet P by the sheet detection section 75. The conveyance wait period T3 will be described later. It is desirable to set the delay period T4 within a time range where a deflection formed in a sheet P does not collide with a conveyance guide 70 (see FIG. 6) of the sheet conveyance section 7. Thus, generation of collision noise, which may be caused at collision of a deflection in a sheet P with the conveyance guide 70, can be prevented.

<Step S3>

At the step S3, the control section 5 determines whether the forced conveyance period T1 elapses. When the control section 5 determines that the forced conveyance period T1 elapses (Yes in S3), the routine proceeds to a step S7. By contrast, when the control section 5 determines that the forced conveyance period T1 does not elapse yet (No in S3), the routine proceeds to a step S4.

<Step S4>

At the step S4, the control section 5 determines whether the sheet P is present at or absent from the position of the sheet detection section 75 with the use of the signals from the sheet detection section 75. When the control section 5 determines that the sheet P is present at the position of the sheet detection section 75 (Yes in S4), the routine proceeds to a step S5. By contrast, when the control section 5 determines that the sheet P is absent from the position of the sheet detection section 75 (No in S4), the routine returns to the step S3. Accordingly, where the sheet P is undetected in the sheet detection section 75, the routine proceeds to a step S7 after the forced conveyance period T1 elapses.

<Step S5>

At the step S5, the control section 5 starts measuring the predetermined conveyance wait period T3 from determination that the sheet P is present at the position of the sheet detection section 75 with the use of the signals from the sheet detection section 75. Then, the routine proceeds to a step S6. The conveyance wait period T3 is a logical value predetermined as a period from determination that a sheet P is present at the position of the sheet detection section 75 to formation of a deflection with a second predetermined volume in a sheet P. Specifically, the conveyance wait period T3 is a sum of a first period and a second period. The first period is a period from determination that a sheet P is present at the position of the sheet detection section 75 to time when the leading edge of the sheet P abuts on the registration roller pair 74. The second period is a period from abutment of the leading edge of the sheet P on the registration roller pair 74 to time when the rear edge of the sheet P is conveyed, and a deflection with a second predetermined volume is formed in the sheet P. As described above, the conveyance wait period T3 is a period obtained by subtracting the conveyance period T2 and the delay period T4 from the forced conveyance period T1.

<Step S6>

At the step S6, the control section 5 determines whether the conveyance wait period T3 elapses. When the control section 5 determines that the conveyance wait period T3 elapses (Yes in S6), it is determined that a deflection with the second predetermined volume is formed. Then, the routine proceeds to the step S7. By contrast, until the conveyance wait period T3 elapses (No in S6), the control section 5 suspends the processing at the step S6.

<Step S7>

At the step S7, the control section 5 determines whether the sheet P being conveyed by the sheet conveyance section 7 corresponds to the first sheet P in a job that is currently being carried out. If the sheet P is the first one, the multifunction peripheral 10 may be in a state immediately after the power is turned on or in a state immediately after return from the power saving mode Immediately after turning on the power or returning from the power saving mode, preparation for image formation may not be completed yet in the image forming section 3 because the fixing temperature of the fixing roller 37 may not reach the predetermined temperature, the rotation of the polygon mirror in the LSU 33 may be unstable yet, or so. In view of this, at the step S7, whether or not the possibility that the image forming section 3 is still in preparation for image formation remains is determined according to whether the sheet P is the first one. This branches the routine.

When it is determined that the sheet P is the first one (Yes in S7), the control section 5 determines that there is a possibility that the image forming section 3 is still in preparation for image formation, and then, the routine proceeds to a step S8. By contrast, when it is determined that the sheet P is not the first one (No in S7), the control section 5 determines that preparation for image formation in the image forming section 3 is completed, and then, the routine proceeds to a step S71.

<Step S71>

At the step S71, the control section 5 turns on the registration clutch 85 to start driving the registration roller pair 74. Thus, the sheet P stopped at the registration roller pair 74 is conveyed toward the image forming section 3. In this case, the registration clutch 85 is turned on in the state in which the intermediate roller pair 73 is continued to be driven. Accordingly, an error in conveyance amount, which may be caused due to response delay in off time of the intermediate clutch 84, can be prevented.

As described above, in the multifunction peripheral 10, the registration roller pair 74 is driven in a first situation (Yes in S6) in which the conveyance wait period T3 elapses from detection of a sheet P by the sheet detection section 75 or in a second situation (Yes in S3) in which the forced conveyance period T1 elapses from a start of conveyance of a sheet P loaded on the manual feed tray 76 or the sheet feed cassette 4. The second drive controller 52 drives the registration roller pair 74 in the first situation. By contrast, the third drive controller 53 drives the registration roller pair 74 in the second situation.

Further, in driving the registration roller pair 74, the control section 5 executes positioning of a write starting point where an image is written to the photosensitive drum 31 and the leading edge of a sheet P. Specifically, the control section 5 controls timing of a writing start when the LSU 33 starts writing an electrostatic latent image to the photosensitive drum 31 by reference to timing of a driving start when the registration roller pair 74 starts being driven at the step S71. Thus, formation of an electrostatic latent image on the photosensitive drum 31 can be started so that an image is formed at a predetermined position of the sheet P.

<Step S8>

At the step S8, the control section 5 determines whether the image forming section 3 completes preparation for image formation. In one example, the control section 5 determines that preparation for image formation is completed if the temperature of the fixing roller 37 reaches a predetermined fixing temperature, and the polygon minor in the LSU 33 is stably rotated.

When the control section 5 determines that preparation for image formation is completed (Yes in S8), the routine proceeds to the step S71. By contrast, when the control section 5 determines that preparation for image formation is not yet completed (No in S8), the routine proceeds to a step S9. Accordingly, in the case where the multifunction peripheral 10 continuously performs a plurality of jobs that accompany the image formation processing, if the current job is the second or following job, the registration roller pair 74 can be driven without suspending the driving of the intermediate roller pair 73 even when the currently conveyed sheet P is the first one in the job.

<Step S9>

At the step S9, the control section 5 suspends rotation of the intermediate roller pair 73 to stop conveyance of the sheet P. Then, the routine proceeds to a step S10. Specifically, the control section 5 turns off the intermediate clutch 84 or suspends driving of the motor 81 to stop conveyance of the sheet P. In other words, the driving of the intermediate roller pair 73 is suspended to stop conveyance of the sheet P after the conveyance wait period T3 elapses from the time when the control section 5 determines that the sheet P is present at the position of the sheet detection section 75. Alternatively, the driving of the intermediate roller pair 73 is suspended to stop conveyance of the sheet P when the control section 5 determines that preparation for image formation is not yet completed after elapse of the forced conveyance period T1 from a start of conveyance of the sheet P.

<Step S10>

At the step S10, the control section 5 starts driving the intermediate roller pair 73 and the registration roller pair 74 after the image forming section 3 completes preparation for image formation. This allows the sheet P to be conveyed toward the photosensitive drum 31. Specifically, the control section 5 drives the motor 81 and turns on the intermediate clutch 84 and the registration clutch 85 to start driving the intermediate roller pair 73 and the registration roller pair 74.

In this case, in driving the registration roller pair 74, the control section 5 also executes positioning of a write starting point where an image is written to the photosensitive drum 31 and the leading edge of the sheet P. Specifically, the control section 5 controls timing of a writing start when the LSU 33 starts writing an electrostatic latent image to the photosensitive drum 31 by reference to timing of a driving start when the registration roller pair 74 starts being driven in the step S10. Thus, formation of an electrostatic latent image on the photosensitive drum 31 can be started so that an image is formed at a predetermined position of the sheet P.

<Step S11>

After the registration roller pair 74 starts to be driven, the control section 5 determines whether all jobs that accompany the image information processing are completed in the step 11. When it is determined that all jobs that accompany the image formation processing are completed (Yes in S11), the control section 5 terminates the series of sheet conveyance processing. By contrast, when the control section 5 determines that not all jobs that accompany the image formation processing are completed (No in S11), the routine returns to the step S1 so that the sheet conveyance processing is repeated for any remaining to-be-printed sheets P.

As has been described so far, when the control section 5 determines that a sheet P is present at the position of the sheet detection section 75, the sheet P is conveyed to the image forming section 3 after a deflection with a predetermined first volume is formed in the sheet P in the conveyance wait period T3. Also, even when the control section 5 determines that a sheet P is absent from the position of the sheet detection section 75, the sheet P is conveyed to the image forming section 3 after a deflection with the second predetermined volume is formed in the forced conveyance period T1. Accordingly, control on timing of a driving start of the registration roller pair 74 according to a detection result by the sheet detection section 75 can avoid disadvantages, such as a sheet jam, sheet bending, etc. in a structure to form a deflection in a sheet P.

Forced driving of the registration roller pair 74 after elapse of the forced conveyance period T1 may be done regardless of the type of a sheet P. Alternatively, the forced driving of the registration roller pair 74 may be done only when the type of a sheet P is a specific sheet type set in advance as a sheet type that is difficult to be detected by the sheet detection section 75. Specifically, the control section 5 receives setting of a sheet type of a to-be-conveyed sheet P through user's manipulation on the operation display section 6. This processing is executed by the sheet type setting section 54. The control section 5 changes, for example, the conveyance speed of the sheet conveyance section 7, the rotation speed of the photosensitive drum 31, the fixing temperature of the fixing roller 37, or the like according to the type of a sheet P. Further, the control section 5 executes the steps S2 and S3 only when the type of a sheet P is the predetermined specific sheet type, such as a viewgraph. The steps S2 and S3 are omitted when the sheet P is any of the other sheet types. In other words, according to the sheet type of the sheet P, the control section 5 enables/disables forced driving of the registration roller pair 74 after the forced conveyance period T1 elapses. Accordingly, unnecessary forced driving of the registration roller pair 74 can be prevented from being performed on a sheet P of a sheet type that the sheet detection section 72 can detect inherently reliably, such as paper. Thus, influence on other control can be prevented which may be caused by such unnecessary forced driving.

[Sheet Conveyance Operation in Multifunction Peripheral 10]

Figure 4:
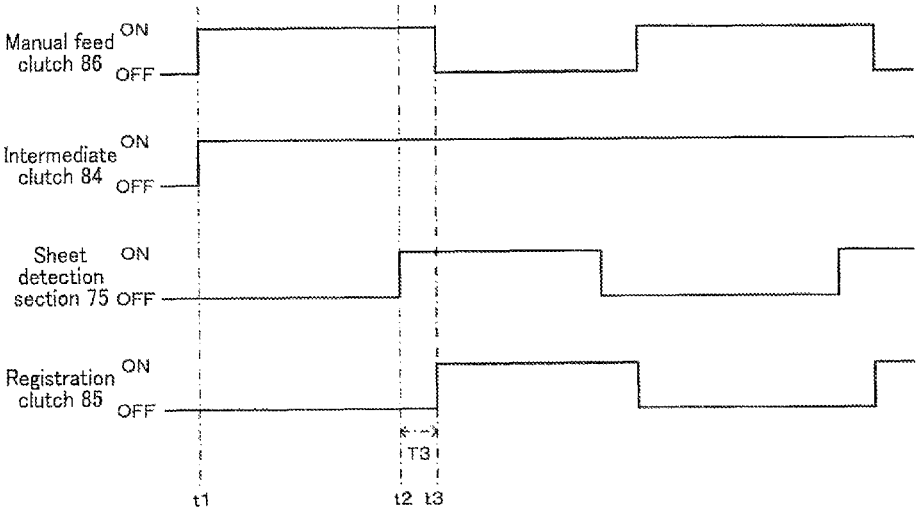
FIG. 4 is a timing chart showing an operation of the multifunction peripheral according to one embodiment of the present disclosure.
Figure 5:
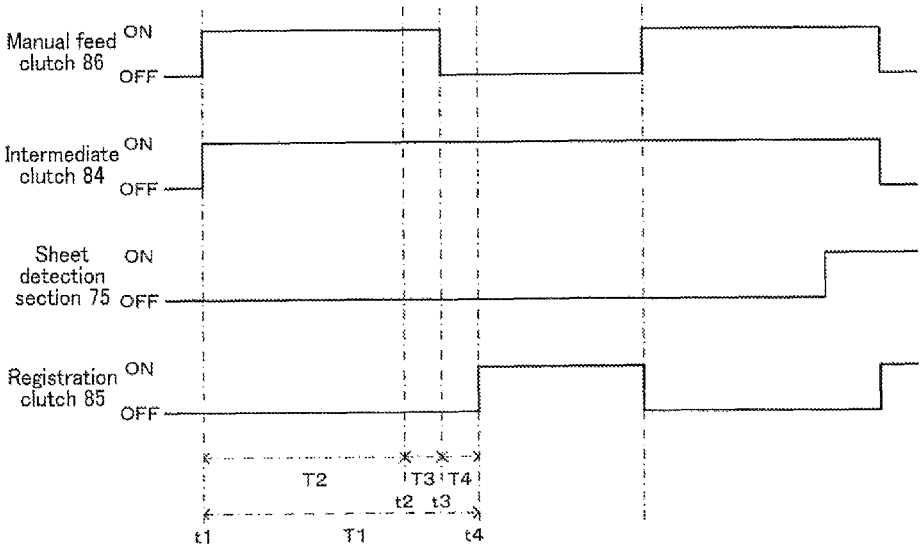
FIG. 5 is a timing chart showing an operation of the multifunction peripheral according to one embodiment of the present disclosure.
Figure 6:
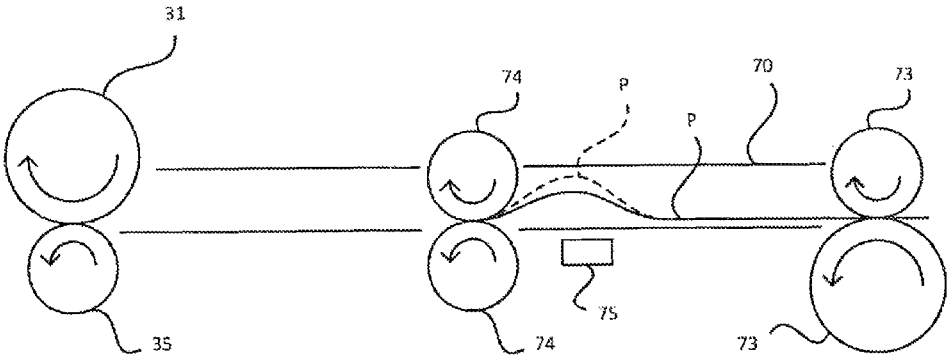
FIG. 6 is an illustration for explaining an operation of the multifunction peripheral according to one embodiment of the present disclosure.

With reference to FIGS. 4-6, description will be made below about operation examples of the multifunction peripheral 10 when the sheet conveyance processing is performed. FIG. 4 shows an operation example where the sheet detection section 75 detects a sheet P. FIG. 5 shows an operation example where the sheet detection section 75 detects no sheet P. FIG. 6 is an illustration conceptually showing the sheet conveyance path in the sheet conveyance section 7. In FIG. 6, the intermediate roller pair 73, the registration roller pair 74, and the photosensitive drum 31 are shown at the same height level. It is noted that the direction from right to left in FIG. 6 is the sheet conveyance direction. One example will be described herein in which supply of a sheet P from the manual feed tray 76 is set in advance in the control section 5 through user's manipulation on the operation display section 6, and then, image formation is performed.

[Operation when a Sheet is Detected]

With reference to FIGS. 4 and 6, description will be made first about an operation example of the multifunction peripheral 10 when the sheet detection section 75 detects a sheet P in the state in which the image forming section 3 completes preparation for image formation.

When the motor 81 is driven first, and the manual feed clutch 86 and the intermediate clutch 84 are turned on (time t1), as shown in FIG. 4, a sheet P is conveyed from the manual feed tray 76 toward the registration roller pair 74.

Next, when the sheet P is conveyed up to a predetermined point on the upstream side of the registration roller pair 74 in the sheet conveyance direction, the sheet P is detected by the sheet detection section 75 (time t2). At the time t2, the registration clutch 85 is turned off, so that the driving of the registration roller pair 74 is suspended.

Subsequently, the on state of the intermediate clutch 84 and the off state of the registration clutch 85 continue until the conveyance wait period T3 elapses, so that a deflection with the second predetermined volume is formed in the sheet P, as indicated by the solid line in FIG. 6. Thus, the leading edge of the sheet P is aligned to the nip part of the registration roller pair 74, thereby correcting inclination (skew) of the sheet P.

When the conveyance wait period T3 lapses (time t3), the registration clutch 85 is turned on, while the intermediate clutch 84 remains turned on. Thus, the sheet P is conveyed toward the photosensitive drum 31. At this time, the control section 5 controls synchronization between timing of turning on the registration clutch 85 and timing of a start of image formation by the image forming section 3 for a start of formation of an electrostatic latent image on the photosensitive drum 31. Thus, an image is formed at a predetermined position of the sheet P.

[Operation when No Sheet is Detected]

With reference to FIGS. 5 and 6, description will be made next about an operation example of the multifunction peripheral 10 when the sheet detection section 75 detects no sheet P in the state in which the image forming section 3 completes preparation for image formation. As described above, where a sheet P is a specific sheet, such as a viewgraph or the like, the sheet detection section 75 may not be able to detect the sheet P.

Although a sheet P loaded on the manual feed tray 76 is conveyed to the sheet detection section 75, if the sheet detection section 75 cannot detect the sheet P, the registration roller pair 74 does not start being driven (time t2), as shown in FIG. 5. Accordingly, the intermediate roller pair 73 remains driven, while the driving of the registration roller pair 74 remains suspended, thereby forming a deflection with a volume larger than the second predetermined volume.

The above sheet conveyance processing by the control section 5 in the multifunction peripheral 10 results in turning on the registration clutch 85 at the time t4 when the forced conveyance period T1 elapses from the start of conveyance of the sheet P loaded on the manual feed tray 76. This causes the sheet P to be conveyed toward the photosensitive drum 31.

Accordingly, a deflection with the first predetermined volume is formed in the sheet P as indicated by the broken line in FIG. 6. The deflection with the first predetermined volume is a deflection of which volume is limitedly increased from the second predetermined volume by the delay period T4. It is noted that until the image forming section 3 completes preparation for image formation, driving of the intermediate roller pair 73 is suspended to restrict formation of a deflection in the sheet P.

Thus, where the sheet detection section 75 in the multifunction peripheral 10 detects no sheet P, the conveyance of the sheet P is limited. This can avoid disadvantages, such as a sheet jam, sheet bending, etc. As described above, it is desirable to set the delay period T4 within a range that causes no sheet bending and also causes no collision of a deflection in a sheet P with the conveyance guide 70, as shown in FIG. 6. Thus, noise, which may be caused due to collision of a sheet P with the conveyance guide 70, can be prevented from being generated.

[Other Embodiments]

Figure 7:
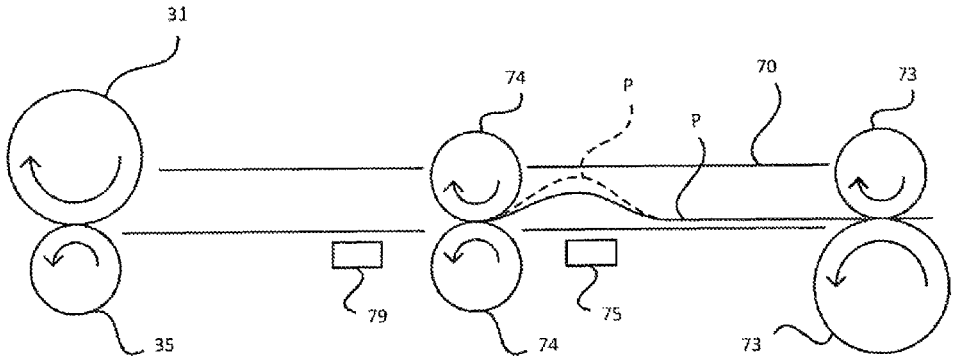
FIG. 7 is an illustration showing another configuration of the multifunction peripheral according to one embodiment of the present disclosure.

Other embodiments of the present disclosure will be described next with reference to FIG. 7. As shown in FIG. 7, the sheet conveyance section 7 of the multifunction peripheral 10 according to another embodiment includes a sheet detection section 79 arranged between the registration roller pair 74 and the photosensitive drum 31. The sheet detection section 79 corresponds to a second sheet detection section.

The sheet detection section 79 is a sensor to detect the presence/absence of a sheet P between the registration roller pair 74 and the photosensitive drum 31. In one example, the sheet detection section 79 may be a displacement type sensor to mechanically detect the presence/absence of a sheet P. In the case where the sheet detection section 79 is a displacement type sensor, the sheet detection section 79 includes an actuator (contact portion) that displaces upon contact with a sheet P and an optical sensor to detect displacement of the actuator. Alternatively, the sheet detection section 79 may be an image sensor or the like to detect the presence/absence of a sheet P on the basis of a captured image.

The control section 5 determines the position of the leading edge of a sheet P according to a detection result by the sheet detection section 79. The control section 5 controls timing of image formation by the image forming section 3 on the basis of the determined position of the leading edge of the sheet P. More specifically, the control section 5 includes, as shown in FIG. 2, a timing controller 55 to control timing of image formation by the image forming section 3 according to timing of sheet detection by the sheet detection section 79. Thus, even when a response of, for example, the registration clutch 85 is delayed, an image can be formed at a predetermined position of a sheet P regardless of its influence. Accordingly, the multifunction peripheral 10 is especially suitable for high speed printing.

Further, the control section 5 may include an abnormality detection section 56, as shown in FIG. 2. The abnormality detection section 56 detects abnormality in sheet conveyance where the sheet detection section 79 detects no sheet P until a predetermined abnormality conveyance period elapses from a start of conveyance of a sheet P loaded on the manual feed tray 76 or the sheet feed cassette 4. This enables detection of the fact that a sheet P does not actually reach the registration roller pair 74 when the registration roller pair 74 is driven without sheet detection by the sheet detection section 75.

Furthermore, the control section 5 may include a re-conveyance controller 57, as shown in FIG. 2. The re-conveyance controller 57 allows a sheet P to be conveyed again from the manual feed tray 76 or the sheet feed cassette 4 upon detection of abnormality in sheet conveyance. This can allow continuation of image formation without need of user's labor in the case where the cause of non-detection of a sheet P is that the sheet P is not actually conveyed to the registration roller pair 74. It is noted that the control section 5 executes a control program stored in the ROM with the use of the CPU to function as the timing controller 55, the abnormality detection section 56, and the re-conveyance controller 57.

What is claimed is:

1. A sheet conveyor device comprising:

a registration roller configured to convey a sheet toward an image forming section for image formation;

an intermediate roller configured to convey the sheet toward the registration roller;

a first sheet detection section configured to optically detect the sheet between the registration roller and the intermediate roller;

a first drive controller configured to drive the intermediate roller while suspending driving of the registration roller;

a second drive controller configured to drive the registration roller when a predetermined conveyance wait period elapses from detection of the sheet by the first sheet detection section; and a third drive controller configured to drive the registration roller when a predetermined forced conveyance period elapses from a start of conveyance of the sheet loaded on a sheet loading section.

2. A sheet conveyor device according to claim 1, wherein the second drive controller suspends driving of the intermediate roller when the conveyance wait period elapses from detection of the sheet by the first sheet detection section and drives the registration roller and the intermediate roller after the image forming section completes preparation for image formation, and the third drive controller suspends driving of the intermediate roller when the forced conveyance period elapses from the start of conveyance of the sheet loaded on the sheet loading section and drives the registration roller and the intermediate roller after the image forming section completes the preparation for image formation.

3. A sheet conveyor device according to claim 1 further comprising:

a second sheet detection section configured to detect the sheet between the registration roller and the image forming section; and an abnormality detection section configured to detect abnormality in sheet conveyance where the second sheet detection section detects no sheet until a predetermined abnormality conveyance period elapses from the start of conveyance of the sheet loaded on the sheet loading section.

4. A sheet conveyor device according to claim 3, further comprising:

a re-conveyance controller configured to allow a sheet to be conveyed again from the sheet loading section upon detection of the abnormality in sheet conveyance by the abnormality detection section.

5. A sheet conveyor device according to claim 1, further comprising:

a sheet type setting section configured to receive an operation of setting a sheet type of a to-be-conveyed sheet, wherein the third drive controller becomes active only when the sheet type setting section receives setting of a predetermined specific sheet type as a sheet type of the to-be-conveyed sheet.

6. An image forming apparatus, comprising:

a sheet conveyor device according to claim 1; and the image forming section.

7. An image forming apparatus, comprising:

a sheet conveyor device according to claim 3; and the image forming section.

8. An image forming apparatus according to claim 7, further comprising:

a timing controller configured to control timing of image formation by the image forming section according to timing of detection of the sheet by the second sheet detection section.

* * * * *